US012201216B2

(12) United States Patent
LeBlanc

(10) Patent No.: US 12,201,216 B2
(45) **Date of Patent: *Jan. 21, 2025**

(54) FLAT PACK SHELF AND BRACKET SYSTEM

(71) Applicant: Lewis Hyman, Inc., Carson, CA (US)

(72) Inventor: Robert LeBlanc, Kennesaw, GA (US)

(73) Assignee: Lewis Hyman, Inc., Carson, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/134,357

(22) Filed: Apr. 13, 2023

(65) Prior Publication Data

US 2023/0248148 A1 Aug. 10, 2023

Related U.S. Application Data

(63) Continuation-in-part of application No. 17/952,524, filed on Sep. 26, 2022.

(60) Provisional application No. 63/248,277, filed on Sep. 24, 2021.

(51) Int. Cl.
*A47B 96/07* (2006.01)
*A47B 96/06* (2006.01)

(52) U.S. Cl.
CPC ..... *A47B 96/07* (2013.01); *A47B 96/067* (2013.01)

(58) Field of Classification Search
CPC ..... A47B 96/028; A47B 96/061; A47B 2220/0036
USPC ..... 108/108
See application file for complete search history.

(56) References Cited

U.S. PATENT DOCUMENTS

| | | | | |
|---|---|---|---|---|
| 830,943 | A | 9/1906 | Wessels | |
| 1,599,653 | A | 9/1926 | Cranston | |
| 1,892,687 | A * | 1/1933 | Teufel | A47G 25/0685 33/8 |

(Continued)

FOREIGN PATENT DOCUMENTS

| | | |
|---|---|---|
| CN | 1310591 | 8/2001 |
| CN | 102078093 | 6/2011 |

(Continued)

OTHER PUBLICATIONS

Amazon.com, Homewell Wood Floating Shelves for Home Decoration, Grey: Furniture & Decor, earliest review Jan. 30, 2018, 10 pages.

(Continued)

*Primary Examiner* — Janet M Wilkens
*Assistant Examiner* — Timothy M Ayres
(74) *Attorney, Agent, or Firm* — Thomas | Horstemeyer, LLP

(57) ABSTRACT

The present disclosure provides a shelf and bracket system that comprises a shelf and a bracket assembly. In various embodiments, the bracket assembly comprises a main bracket bar, a plurality of support arms, and hardware for attaching each of the plurality of support arms to the main bracket bar. In addition, in various embodiments, each support arm is disposed adjacent a respective end of the main bracket bar and the respective first hardware for the support arm is configured such that, when disengaged, the support arm is configured to rotate between a shelf support position and a folded storage position so that when each of the plurality of support arms are in the folded storage position, the bracket assembly is substantially flat.

20 Claims, 13 Drawing Sheets

(56) References Cited

U.S. PATENT DOCUMENTS

| | | | | |
|---|---|---|---|---|
| 3,143,980 | A | 8/1964 | Sperring | |
| 3,284,040 | A | 11/1966 | Marontate | |
| 3,463,433 | A * | 8/1969 | Coe | A47B 57/42 248/242 |
| 4,071,216 | A * | 1/1978 | Einhorn | A47B 96/061 248/282.1 |
| 4,934,645 | A * | 6/1990 | Breslow | A47B 96/07 248/242 |
| D341,819 | S * | 11/1993 | Carlstrom | D8/381 |
| 5,316,253 | A | 5/1994 | Flathau et al. | |
| 5,452,875 | A * | 9/1995 | Kern | A47B 57/045 248/242 |
| 5,775,655 | A | 7/1998 | Schmeets | |
| 6,098,566 | A | 8/2000 | Metcalf | |
| 6,164,610 | A | 12/2000 | Santiago | |
| 7,178,775 | B2 * | 2/2007 | Pfister | F16M 11/10 248/920 |
| 9,594,933 | B2 | 3/2017 | Kuniavsky et al. | |
| 9,861,198 | B2 | 1/2018 | Anderson | |
| 10,575,641 | B1 | 3/2020 | Severa | |
| 11,116,317 | B2 * | 9/2021 | LeBlanc | A47B 96/067 |
| 11,272,795 | B2 | 3/2022 | Landgren | |
| 11,641,942 | B1 * | 5/2023 | Rockley | A47B 96/061 211/90.02 |
| 11,825,946 | B1 | 11/2023 | Anderson | |
| 2009/0224119 | A1 | 9/2009 | Heffernan | |
| 2017/0023174 | A1 * | 1/2017 | Harmon | A61H 3/02 |
| 2022/0395097 | A1 | 12/2022 | Horezga | |
| 2023/0129858 | A1 | 4/2023 | Anderson | |

FOREIGN PATENT DOCUMENTS

| | | |
|---|---|---|
| CN | 201870125 U | 6/2011 |
| CN | 104510179 | 4/2015 |
| EP | 3005904 | 4/2016 |
| GB | 2214414 | 9/1989 |
| GB | 2293963 | 4/1996 |
| JP | 2016083244 | 5/2016 |

OTHER PUBLICATIONS

Notice of Allowance, dated Feb. 3, 2023, from corresponding U.S. Appl. No. 17/473,638.

Notice of Allowance, dated May 27, 2021, from corresponding U.S. Appl. No. 16/677,206.

Office Action, dated Nov. 20, 2020, from corresponding U.S. Appl. No. 16/677,206.

Office Action, dated Sep. 8, 2022, from corresponding U.S. Appl. No. 17/473,638.

Office Action, dated Dec. 21, 2023, from corresponding U.S. Appl. No. 17/952,524.

Office Action, dated Jan. 17, 2024, from corresponding U.S. Appl. No. 18/329,123.

* cited by examiner

FLAT PACK SHELF AND BRACKET SYSTEM

CROSS-REFERENCE TO RELATED APPLICATION

This application is a continuation in part of U.S. patent application Ser. No. 17/952,524, filed Sep. 26, 2022, which claims the benefit of priority to U.S. Provisional Patent Application No. 63/248,277, filed Sep. 24, 2021, both of which are hereby incorporated by reference in their entirety for all purposes.

FIELD OF THE INVENTION

The present disclosure is generally related to a shelf and bracket system, as well as processes for installing the shelf and bracket system.

BACKGROUND

A traditional process for hanging a shelf involves: (1) acquiring two separate support arms and a shelf; (2) mounting the arms on a wall so that the arms are horizontally offset from one another, and so that the upper surfaces of the arms are at the same height on the wall; and (3) installing the shelf so that it is in a horizontal position and supported by the upper support surfaces of the respective offset support arms. One problem with this process is that it can be difficult for users to install the support arms so that the support arms are at least approximately the same height (which is generally required for the shelf to lay horizontally level across the support arms).

SUMMARY

A shelf and bracket system, in various embodiments, comprises: (1) a shelf; and (2) a bracket assembly. In some aspects, the bracket assembly comprises: (1) a main bracket bar, (2) a plurality of support arms, (3) first hardware for attaching each of the plurality of support arms to the main bracket bar, (4) second hardware for attaching the shelf to each of the plurality of support arms, and (5) third hardware for attaching the main bracket bar to a vertical support surface, wherein each support arm is disposed adjacent a respective end of the main bracket bar and the respective first hardware for the support arm is configured such that, when disengaged, the support arm is configured to rotate between a shelf support position and a folded storage position so that when each of the plurality of support arms are in the folded storage position, the bracket assembly is substantially flat. In some embodiments, each of the plurality of support arms is configured to direct at least a portion of a weight of the shelf into the vertical support surface when the plurality of support arms are in the shelf support position.

In various embodiments, each of the plurality of support arms is configured to put weight onto the main bracket bar while minimizing shear force on the first hardware when the plurality of support arms are in the shelf support position. In particular embodiments, the first hardware is substantially spool-shaped. In various embodiments, the main bracket bar comprises an elongated cutout for each of the plurality of support arms to allow for an adjustment of spacing between the plurality of support arms by sliding a respective support arm laterally closer or farther away from at least one other of the plurality of support arms. In particular embodiments, each of the plurality of support arms comprises a recess at the respective end of the support arm to maintain the support arm in a substantially perpendicular orientation relative to the main bracket bar when the first hardware is engaged with one or more outside surfaces of the main bracket bar to attach the support arm to the main bracket bar.

In some embodiments, the first hardware for the support arm is configured such that, when engaged, the support arm is coupled to the main bracket bar, and the first hardware is slidably disposed in an elongated coupling mechanism support cutout disposed laterally along a width of the main bracket bar. In particular embodiments, the support arm is configured to slide laterally along a length of the elongated coupling mechanism support cutout. In some embodiments, the main bracket bar defines a routed cutout disposed adjacent an outer end of the elongated coupling mechanism support cutout. In particular embodiments, the first hardware is configured to disengage when the first hardware is disposed within the routed cutout such that the support arm can rotate with respect to the main bracket bar about the first hardware.

In various embodiments, the routed cutout is defined by a curved line that extends between a first point adjacent an end of the elongated coupling mechanism support cutout and a second point that is centrally disposed between a main bracket bar top surface and a main bracket bar bottom surface. In some aspects, the routed cutout defines a ledge configured to engage a flange of the first hardware when the first hardware is disposed in the routed cutout.

A shelf and bracket system, in particular embodiments comprises a shelf; and a bracket assembly that comprises: (1) a main bracket bar, (2) a plurality of support arms, and (2) hardware for attaching each of the plurality of support arms to the main bracket bar, wherein each support arm is disposed adjacent a respective end of the main bracket bar and the respective first hardware for the support arm is configured such that, when disengaged, the support arm is configured to rotate between a shelf support position and a folded storage position so that when each of the plurality of support arms are in the folded storage position, the bracket assembly is substantially flat. In some aspects, each respective first hardware comprises a cylinder having a first flange disposed on a first end of the cylinder and a second flange disposed on a second end of the cylinder. In particular aspects, the first flange is configured to engage the main bracket bar and the second flange is configured to engage a particular support arm of the plurality of support arms to maintain the main bracket bar adjacent the particular support arm. In some embodiments, each respective first hardware is slidably disposed within a coupling mechanism cutout. In various embodiments, each of the plurality of support arms comprises a recess at the respective end of the support arm to maintain the support arm in a substantially perpendicular orientation relative to the main bracket bar when the hardware is engaged with one or more outside surfaces of the main bracket bar to attach the support arm to the main bracket bar.

In particular embodiments, the main bracket bar comprises one or more recesses along a length of the main bracket bar, and the shelf comprises one or more slide-ins configured for sliding into the one or more recesses to attach the shelf to the main bracket bar without use of hardware.

A method, in various embodiments, comprises: (1) providing the shelf and bracket system comprising: (A) a shelf, and (B) a bracket assembly that comprises a main bracket bar, a plurality of support arms, and hardware for attaching each of the plurality of support arms to the main bracket bar, wherein each support arm is disposed adjacent a respective end of the main bracket bar and the hardware for the support arm comprises a cylinder having a first flange disposed on a first end of the cylinder and a second flange disposed on a second end of the cylinder and is configured such that, when disengaged, the support arm is configured to rotate between a shelf support position and a folded storage position so that when each of the plurality of support arms are in the folded storage position, the bracket assembly is substantially flat. In some embodiments, the method further comprises: (1) assembling the shelf and bracket system by rotating each support arm of the plurality of support arms to the shelf support position; (2) engaging the hardware to attach each of the plurality of support arms to the main bracket bar, and (3) attaching each of the plurality of support arms to the shelf.

BRIEF DESCRIPTION OF THE DRAWINGS

In the course of this description, reference will be made to the accompanying drawings, which are not necessarily drawn to scale, and wherein.

DETAILED DESCRIPTION

Figure 1:
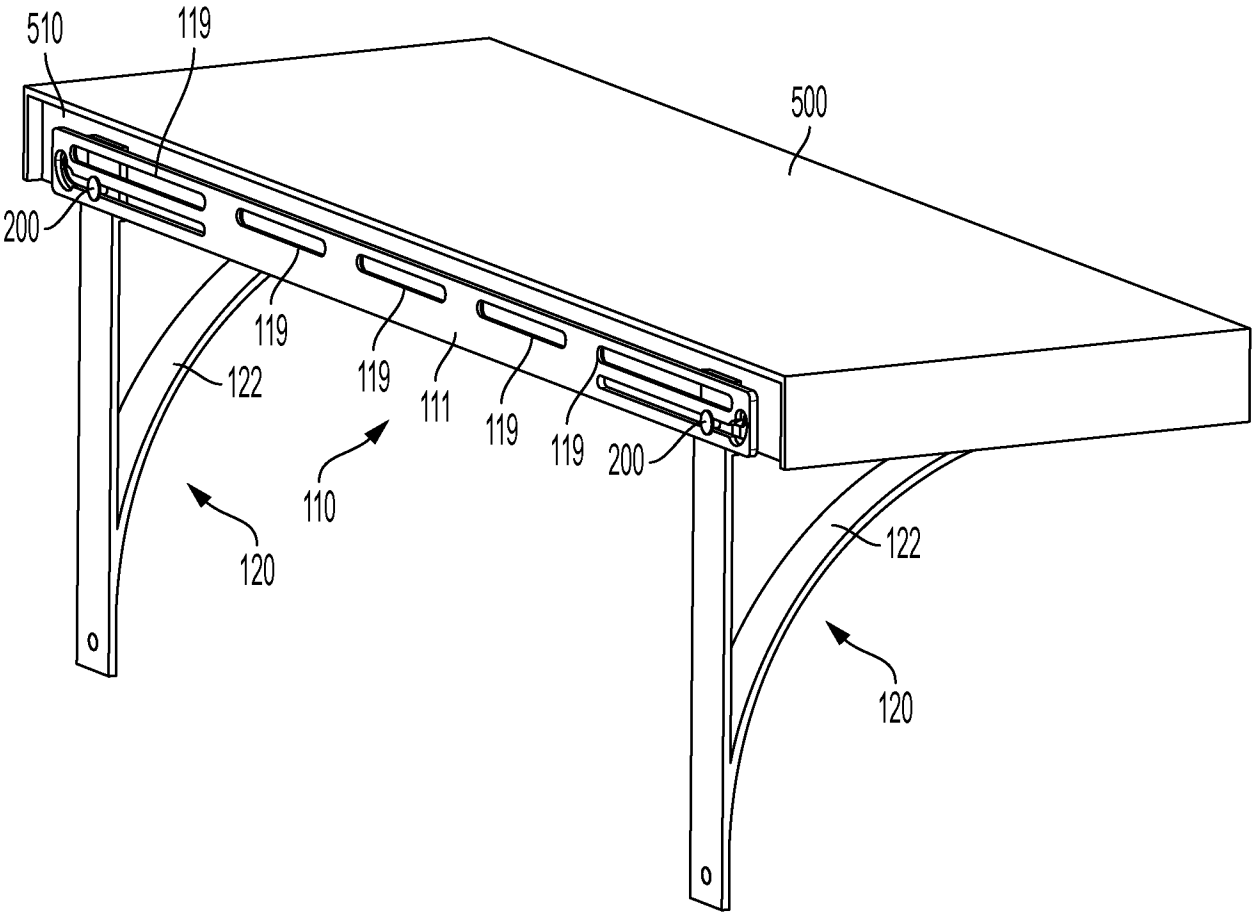
FIG. 1 is a rear perspective view of a shelf and bracket system according to various embodiments of the present disclosure.

While this disclosure is illustrative of embodiments in many different forms, there are shown in the drawings, and will herein be described in detail, example embodiments of the disclosure with the understanding that the present disclosure is to be considered as illustrative of the principles of the disclosure, but is not intended to limit the broad aspect of the disclosure to the embodiments illustrated. In the following description of various example structures according to the disclosure, reference is made to the accompanying drawings, which form a part hereof, and in which are shown by way of illustration various example devices, systems, and environments in which aspects of the disclosure may be practiced. It is to be understood that other specific arrangements of parts, example devices, systems, and environments may be utilized, and structural and functional modifications may be made without departing from the scope of the present disclosure.

In addition, it is to be understood that the phraseology and terminology employed herein are for the purpose of description and should not be regarded as limiting. For example, the use of a singular term, such as, "a" is not intended as limiting of the number of items. Also the use of relational terms, such as but not limited to, "top," "bottom," "left," "right," "upper," "lower," "down," "up," "side," are used in the description for clarity and are not intended to limit the scope of the disclosure. Further, it should be understood that any one of the features can be used separately or in combination with other features. Other systems, methods, aspects, features, and advantages of the disclosure will be or become apparent to one with skill in the art upon examination of the detailed description. It is intended that all such additional systems, methods, aspects, features, and advantages be included within this description, be within the scope of the present disclosure, and be protected by the accompanying claims.

Various embodiments described herein provide an improved shelf and bracket system in which the system includes: (1) a bracket assembly 110; and (2) a shelf 500. Referring to FIG. 1, an example of a bracket assembly 110 is shown with a shelf 500 coupled to the bracket assembly 110. In various aspects, the shelf bracket 120 (e.g., support arm) includes an angled shelf support 122 to support the weight of the shelf 500 and a shelf support 113 (not pictured) to provide a support surface for the shelf 500. In the embodiment shown in this figure, the bracket assembly 110 comprises: (1) a main bracket bar 111; (2) at least one shelf bracket 120 (e.g., two support arms); and (3) one or more coupling mechanisms (e.g., at least one main bracket bar/shelf bracket coupling mechanism 200) for coupling the main bracket bar 111 to each of the shelf bracket 120. Accordingly, the different components of the bracket assembly can be made of various types of materials such as metals, polymers, composites, woods, and/or the like, and/or any combination thereof. Likewise, the shelf can be made of various types of materials such as metals, polymers, composites, woods, and/or the like, and/or any combination thereof. In still other embodiments, the bracket assembly 110 may utilize any other suitable fasteners (e.g., hardware) for at least temporarily coupling one or more components of the bracket assembly 110 to one another (e.g., for attaching each of the shelf bracket 120 to the shelf 500, for attaching the main bracket bar 111 to a vertical support surface, etc.).

As may be understood from FIG. 1, the shelf 500 may define a rear shelf recess 510 that is sufficiently deep to accommodate the main bracket bar 111 and at least a portion of each shelf bracket 120 when each shelf bracket 120 is coupled to the main bracket bar 111 and supporting the shelf 500. In this way, the shelf and bracket system may be configured such that, when the shelf 500 is disposed on the bracket assembly 110, the back of the shelf 500 is substantially flush (e.g., flush) with a support surface (e.g., wall) on which it is mounted.

Figure 2:
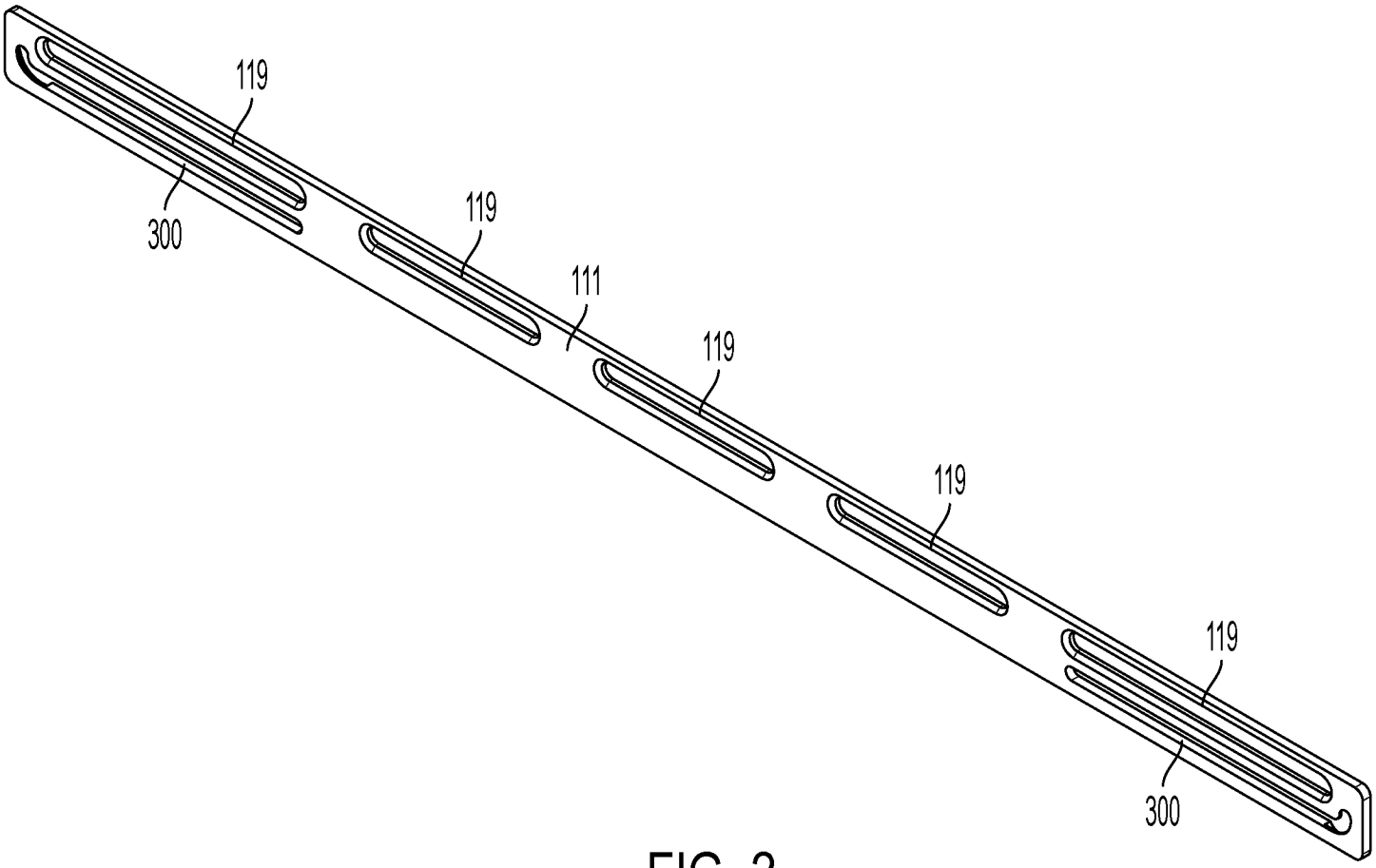
FIG. 2 is a front perspective view of a main bracket bar of the shelf and bracket system according to various embodiments.

Turning to FIG. 2, as noted above, the bracket assembly 110 comprises a main bracket bar 111. FIG. 2 depicts a main bracket bar 111 shown from a front perspective view. As may be understood from FIG. 2, the main bracket bar 111 is substantially rectangular (e.g., rectangular), extends between a first end and a second end, and defines at least one elongated mounting cutout 119 distributed colinearly along a length of the main bracket bar 111. In particular embodiments, each elongated mounting cutout 119 is disposed adjacent an upper portion of the main bracket bar 111. In other embodiments, each elongated mounting cutout 119 may be disposed in any other suitable location along the length of the main bracket bar 111. In particular embodiments, each elongated mounting cutout 119 is substantially rectangular and has rounded ends. In particular embodiments, each elongated mounting cutout 119 has a beveled edge (e.g., that extends around a perimeter of the elongated mounting cutout 119). In this way, each elongated mounting cutout 119 may be dimensioned to accommodate a fastener (e.g., with a round head) to support the main bracket bar 111 adjacent a support surface. As may be understood in light of this disclosure, each elongated mounting cutout 119 is configured to enable a user to secure the main bracket bar 111 to a support surface (e.g., wall) by using a suitable fastener (e.g., by inserting each fastener into the support surface through each at least one elongated mounting cutout 119). In various aspects, the orientation and position of each elongated mounting cutout 119 may provide access, by a fastener though at least one elongated mounting cutout 119, to the support surface for securing. For example, a studded wall may have vertical studs that are substantially evenly spaced (e.g., about 16 inches apart). By positioning and dimensioning each elongated mounting cutout 119 along the length (e.g., width) of the main bracket bar 111, the shelf and bracket system may enable a user to install the bracket assembly 110 (e.g., the main bracket bar 111) in any desired position on a wall, while still being able to secure the main bracket bar 111 to at least one stud (e.g., at least two studs). This may, for example, provide greater support for a shelf 500 mounted using the bracket assembly 110 than would be provided when mounting the bracket assembly 110 directly to drywall (e.g., or provide a more straightforward installation that requiring the use of drywall anchors or other anchoring fasteners). In particular embodiments, the main bracket bar 111 is sufficiently rigid to support at least one shelf bracket 120 such that the at least one shelf bracket 120 can support a shelf 500.

As further illustrated in FIG. 2, the main bracket bar 111 defines at least one coupling mechanism cutout 300. In the embodiment shown in this figure, the main bracket bar 111 defines a respective coupling mechanism cutout 300 on each end of the main bracket bar 111. In the embodiment shown in this figure, the coupling mechanism cutout 300 is substantially parallel to each of the elongated mounting cutout 119. In particular embodiments, each coupling mechanism cutout 300 is disposed on an opposing end of the main bracket bar 111 and arranged in an opposite orientation (e.g., mirror one another). In the embodiment shown in this figure each coupling mechanism cutout 300 is colinear and spaced apart from a centerline of each colinear elongated mounting cutout 119.

Figure 3:
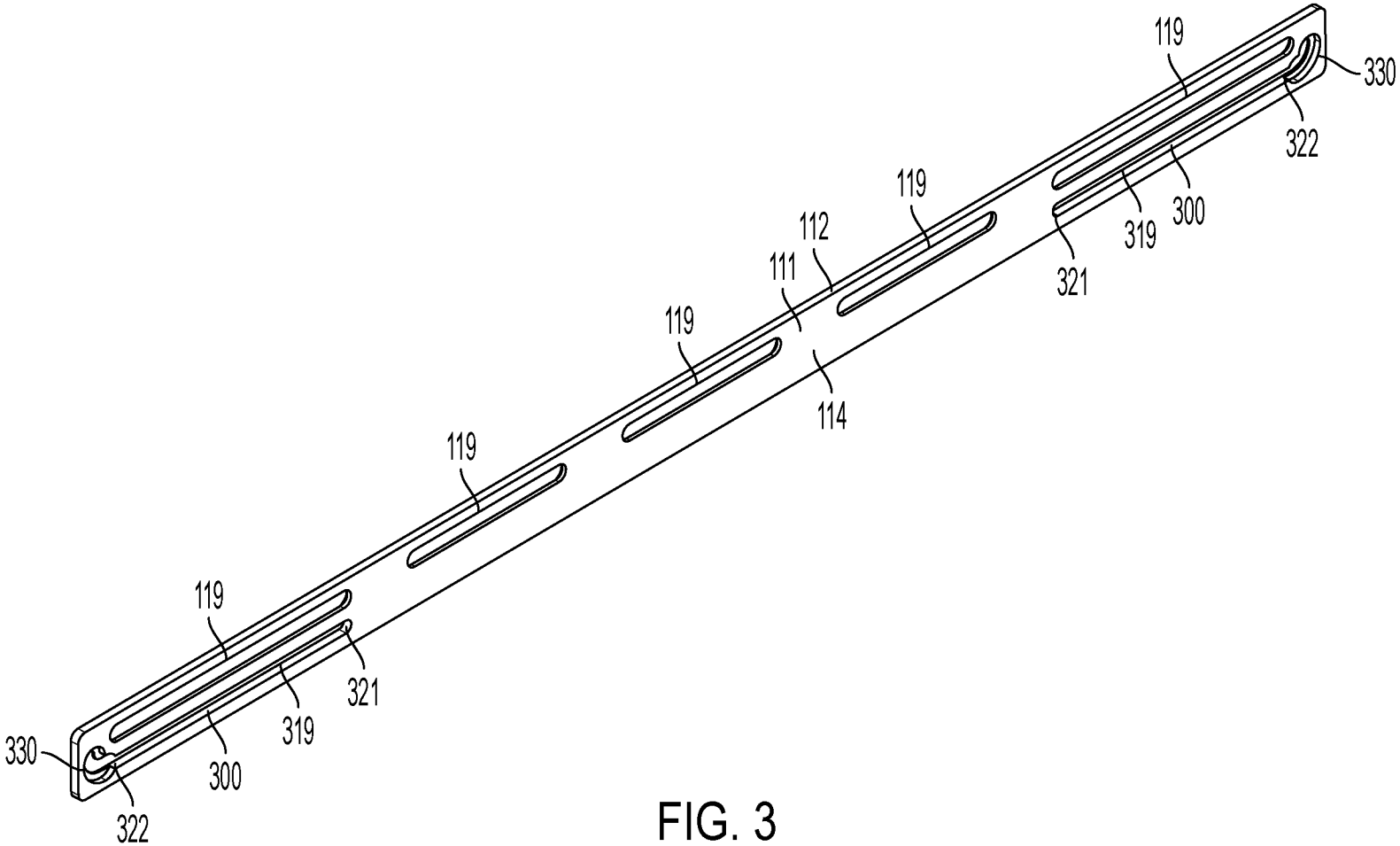
FIG. 3 is a rear perspective view of the main bracket bar shown in FIG. 2.

Turning to FIG. 3, a rear perspective view of the main bracket bar 111 is shown. As may be further understood from the rear perspective view shown in FIG. 3, the coupling mechanism cutout 300 includes a elongated coupling mechanism support cutout 319 that extends from a first end 321 to a second end 322. In various embodiments, the elongated coupling mechanism support cutout 319 has a substantially uniform width along the length of the elongated coupling mechanism support cutout 319 from the first end 321 to the second end 322. On an outer portion of each coupling mechanism cutout 300, is a routed cutout 330. As may be understood in light of this disclosure, the routed cutout 330 is configured to engage and/or at least partially mate with a main bracket bar/shelf bracket coupling mechanism 200 when the main bracket bar/shelf bracket coupling mechanism 200 is coupling a shelf bracket 120 to the main bracket bar 111.

Figure 4:
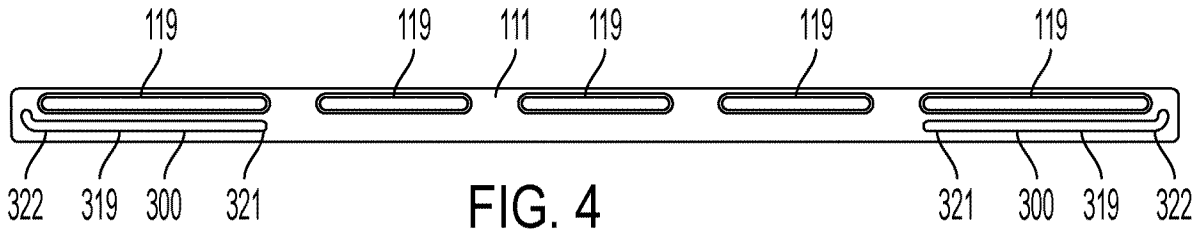
FIG. 4 is a front view of the main bracket bar shown in FIG. 2.

FIG. 4 depicts a front view of a main bracket bar 111. A shown in this figure, the main bracket bar 111 is substantially rectangular (e.g., rectangular) and defines at least one elongated mounting cutout 119 distributed colinearly along a length of the main bracket bar 111. In particular embodiments, each elongated mounting cutout 119 is disposed adjacent an upper portion of the main bracket bar 111. In other embodiments, each elongated mounting cutout 119 may be disposed in any other suitable location along the length of the main bracket bar 111. In particular embodiments, each elongated mounting cutout 119 is substantially rectangular and has rounded ends. In the embodiment shown in this figure, it should be understood that any particular elongated mounting cutout 119 may have any suitable length, and each elongated mounting cutout 119 along the length of the main bracket bar 111 may have a different length. For example, in FIG. 4, each elongated mounting cutout 119 on the outer portion of the main bracket bar 111 (e.g., disposed above each respective coupling mechanism cutout 300) as a first length, while each central elongated mounting cutout 119 (e.g., each of the central three) has a second length. In particular embodiments, the elongated mounting cutout 119 disposed adjacent (e.g., directly above) the coupling mechanism cutout 300 has a length that corresponds to a length of the elongated coupling mechanism support cutout 319 (e.g., extending between the first end 321 and the second end 322).

Figure 5:
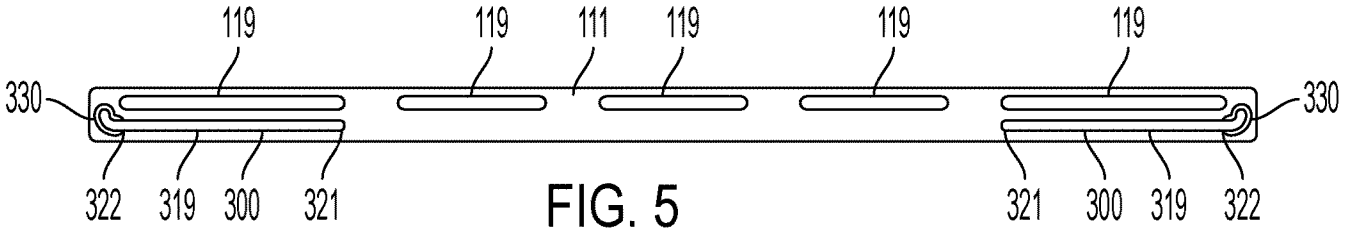
FIG. 5 is a rear view of the main bracket bar shown in FIG. 2.

Turning to FIG. 5, a rear view of the main bracket bar 111 is shown. As may be further understood from the rear view shown in FIG. 5, the coupling mechanism cutout 300 includes a elongated coupling mechanism support cutout 319 that extends from a first end 321 to a second end 322. In various embodiments, the elongated coupling mechanism support cutout 319 has a substantially uniform width along the length of the elongated coupling mechanism support cutout 319 from the first end 321 to the second end 322. In this embodiment, each elongated coupling mechanism support cutout 319 has a length that substantially corresponds to a length of an adjacent elongated mounting cutout 119 (e.g., a elongated mounting cutout 119 disposed above the coupling mechanism cutout 300 on the main bracket bar 111). On an outer portion of each coupling mechanism cutout 300, is a routed cutout 330. As may be understood in light of this disclosure, the routed cutout 330 is configured to engage and/or at least partially mate with a main bracket bar/shelf bracket coupling mechanism 200 when the main bracket bar/shelf bracket coupling mechanism 200 is coupling a shelf bracket 120 to the main bracket bar 111. As may be further understood from FIG. 5, the routed cutout 330 extends from an end of the elongated coupling mechanism support cutout 319 adjacent the second end 322, curving at least partially upward toward the upper side of the main bracket bar 111.

Figure 6:
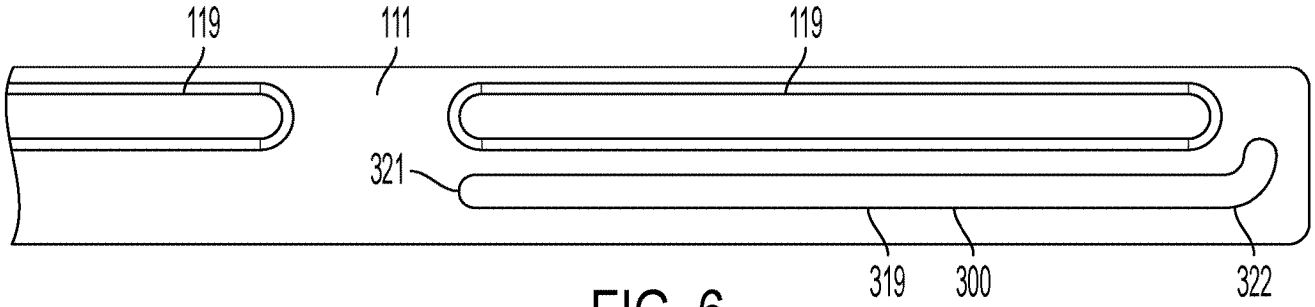
FIG. 6 is a front detail view of the main bracket bar shown in FIG. 2.

FIG. 6 depicts a front detail view of a first end of the main bracket bar 111. As may be understood from this figure, in various embodiments, the elongated mounting cutout 119 is defined on the main bracket bar 111 such that the elongated mounting cutout 119 is parallel to a length of the main bracket bar 111. The elongated coupling mechanism support cutout 319 is similarly defined on the main bracket bar 111 such that the elongated coupling mechanism support cutout 319 is parallel to both the length of the main bracket bar 111 and the elongated mounting cutout 119. In various embodiments, the inner edge of the elongated mounting cutout 119 is adjacent the first end 321 of the elongated coupling mechanism support cutout 319 (e.g., is oriented at substantially the same lateral position as the first end 321 of the elongated coupling mechanism support cutout 319). In particular embodiments, each elongated mounting cutout 119 has a beveled edge, as is shown in FIG. 6's detailed view (e.g., that extends around a perimeter of the elongated mounting cutout 119). In this way, each elongated mounting cutout 119 may be dimensioned to accommodate a fastener (e.g., with a round head) to support the main bracket bar 111 adjacent a support surface. As may be understood in light of this disclosure, each elongated mounting cutout 119 is configured to enable a user to secure the main bracket bar 111 to a support surface (e.g., wall) by using a suitable fastener (e.g., by inserting each fastener into the support surface through each at least one elongated mounting cutout 119, such that the beveled edge supports a head of the fastener). In various aspects, the orientation and position of each elongated mounting cutout 119 may provide access, by a fastener though at least one elongated mounting cutout 119, to the support surface for securing. For example, a studded wall may have vertical studs that are substantially evenly spaced (e.g., about 16 inches apart). By positioning and dimensioning each elongated mounting cutout 119 along the length (e.g., width) of the main bracket bar 111, the shelf and bracket system may enable a user to install the bracket assembly 110 (e.g., the main bracket bar 111) in any desired position on a wall, while still being able to secure the main bracket bar 111 to at least one stud (e.g., at least two studs).

Figure 7:
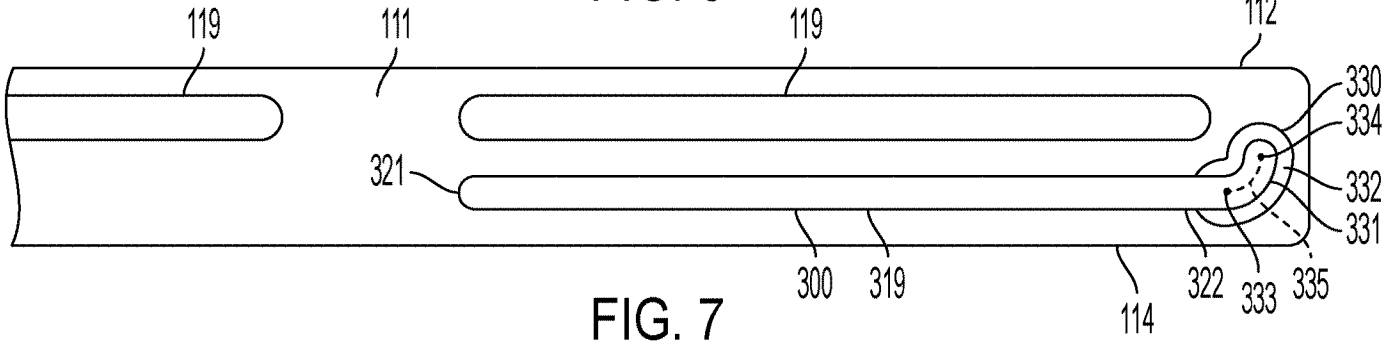
FIG. 7 is a rear detail view of the main bracket bar shown in FIG. 2.

FIG. 7 depicts a front detail view of a second end of the main bracket bar 111. As shown in this figure, the elongated mounting cutout 119 adjacent the second end of the main bracket bar 111 is disposed adjacent the main bracket bar top surface 112 of the main bracket bar 111. The elongated coupling mechanism support cutout 319 is parallel to and spaced apart from the elongated mounting cutout 119 adjacent the second end of the main bracket bar 111, and displayed adjacent the main bracket bar bottom surface 114 of the main bracket bar 111. FIG. 7 provides greater detail of the routed cutout 330 disposed adjacent and extending from the second end 322 of the elongated coupling mechanism support cutout 319. As may be understood from FIG. 7, the routed cutout 330 has an outer edge defined by a substantially circular router having a diameter the width of the routed cutout 330 that has been run from the first point 333 to the second point 334 along a curved line 335 (e.g., substantially j-shaped line). In various aspects the second point 334 is disposes substantially evenly between the main bracket bar top surface 112 and the main bracket bar bottom surface 114. As may be understood from this and the other figures, the routed cutout 330 has a depth that does not extend fully through the main bracket bar 111, resulting in a lip 332 having a thickness that is less than a thickness of the main bracket bar 111. The routed cutout 330 further defines an inner cutout 331 that also follows the line 335 and has a spacing that substantially corresponds to a spacing of the elongated coupling mechanism support cutout 319.

Figure 8:
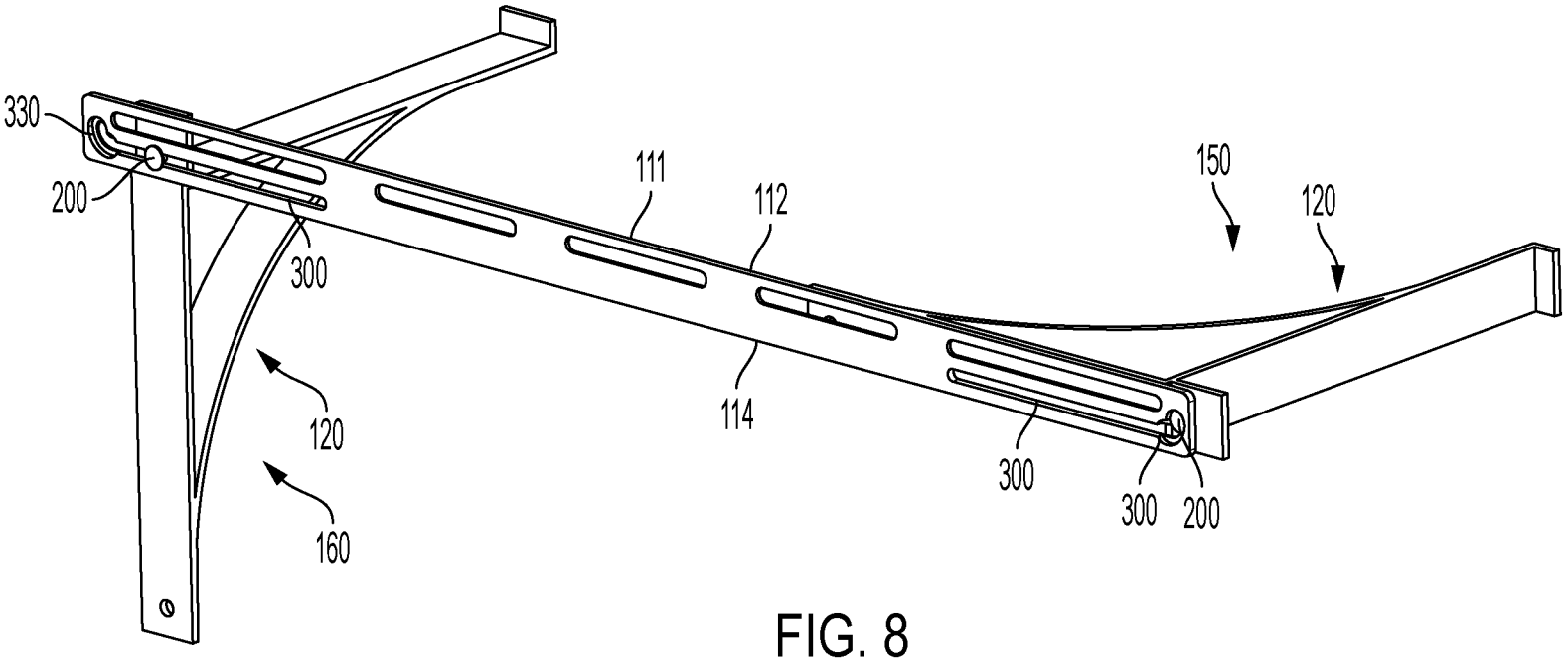
FIG. 8 is a rear perspective view of a shelf and bracket system according to various embodiments of the present disclosure with a first shelf bracket in a support position and a second shelf bracket in a folded position.

FIG. 8 is a rear perspective view of a shelf and bracket system according to various embodiments of the present disclosure with a first shelf bracket 120 in a support position 160 and a second shelf bracket 120 in a folded position 150. As shown in this figure, the shelf bracket 120 in the support position 160 adjacent the first end of the main bracket bar 111 is coupled to the main bracket bar 111 via a main bracket bar/shelf bracket coupling mechanism 200 that extends through a hole in the first shelf bracket 120 and the coupling mechanism cutout 300, with an outer portion of the main bracket bar/shelf bracket coupling mechanism 200 engaging both a rear face of the main bracket bar 111 and a front face of the shelf bracket 120. In this way, the main bracket bar/shelf bracket coupling mechanism 200 may maintain the shelf bracket 120 adjacent the main bracket bar 111. Similarly, the second shelf bracket 120 in the folded position 150 disposed adjacent the second end of the main bracket bar 111 is coupled to the main bracket bar 111 via a main bracket bar/shelf bracket coupling mechanism 200 disposed in the routed cutout 330. As may be understood from this figure, the main bracket bar/shelf bracket coupling mechanism 200 is configured to slide within the coupling mechanism cutout 300 (e.g., and the routed cutout 330) and each shelf bracket 120 is configured to rotate about the main bracket bar/shelf bracket coupling mechanism 200 between the support position 160 and the folded position 150. As shown in this figure, the second shelf bracket 120 in the folded position 150 is disposed such that each outer edge of the second shelf bracket 120 is respectively adjacent the main bracket bar top surface 112 and the main bracket bar bottom surface 114 of the main bracket bar 111. In this way, then each shelf bracket 120 is in the folded position 150, the main bracket bar 111 and each shelf bracket 120 form a substantially flat shelf and bracket system.

Figure 9:
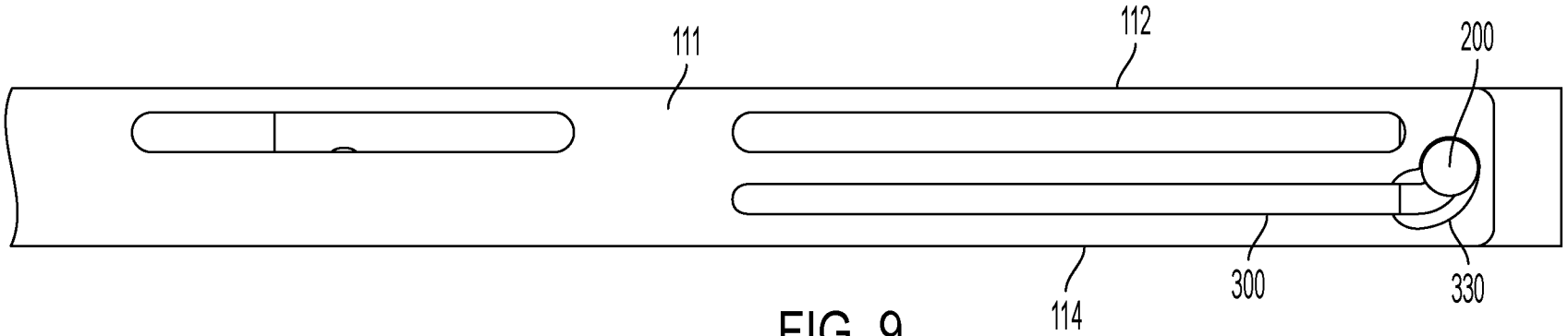
FIG. 9 is a rear detail view of a main bracket bar coupled to a shelf bracket in accordance with various embodiments of the present disclosure.

FIG. 9 is a rear view of the main bracket bar 111 with a shelf bracket coupled to the main bracket bar 111 via a main bracket bar/shelf bracket coupling mechanism 200 engaging the routed cutout 330 of the coupling mechanism cutout 300. As may be understood from this figure, each outer edge of the shelf bracket is respectively parallel to the main bracket bar top surface 112 and the main bracket bar bottom surface 114 of the main bracket bar 111. The shelf bracket 120 may, for example, have a width that corresponds to a height of the main bracket bar 111. In this way, the bracket assembly 110 (e.g., the main bracket bar 111 and each shelf bracket 120) may be configured to lay flat during transportation, display, etc. Such a packing arrangement may reduce shipping volume requirements, which can reduce costs related to distribution and transport of the shelf and bracket system.

Figure 10:
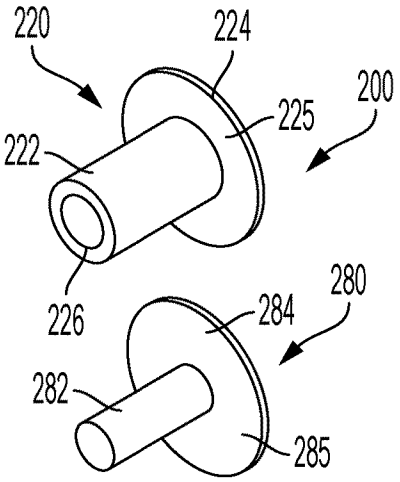
FIG. 10 is a perspective view of a bracket bar/shelf bracket coupling mechanism according to various embodiments of the present disclosure in a separated arrangement.
Figure 11:
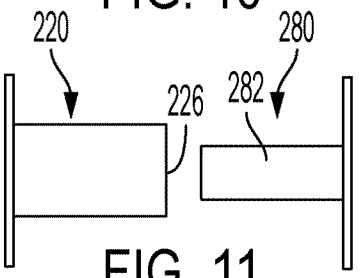
FIG. 11 is a side view of the bracket bar/shelf bracket coupling mechanism shown in FIG. 10.
Figure 12:
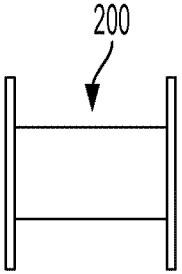
FIG. 12 is a side view of the bracket bar/shelf bracket coupling mechanism of FIG. 10 in a connected arrangement.

FIG. 10, FIG. 11, and FIG. 12 provide detail views of the main bracket bar/shelf bracket coupling mechanism 200. As shown in these figures, the main bracket bar/shelf bracket coupling mechanism 200 comprises a first flanged component 220 and second flanged component 280. In particular embodiments, the first flanged component 220 comprises a first cylindrical portion 222 having a first flange 224 disposed on one end of the first cylindrical portion 222. In some aspects, the first cylindrical portion 222 is substantially round (e.g., round) and cylindrical (e.g., a right, circular cylinder). In particular embodiments, the first flange 224 is substantially circular and has a radius greater than a radius of the first cylindrical portion 2222. In other embodiments, the first flange 224 and/or first cylindrical portion 222 may have any other suitable shape. In particular embodiments, the first flange 224 defines a first flange inner face 225 configured to engage with, for example, an outer face of the shelf bracket 120 (e.g., when the shelf bracket 120 is coupled to the main bracket bar 111), a rear face of the main bracket bar 111, at least a portion of the lip 332, etc.). In particular aspects, the first cylindrical portion 222 defines a second flanged component receiving recess 226 that extends through the first cylindrical portion 222 and is capped by the first flange 224.

In particular embodiments, the second flanged component 280 comprises a second cylindrical portion 282 raving a radius that substantially corresponds to a radius of the second flanged component receiving recess 226. The second flanged component 280 further comprises a second flange 284 (e.g., a substantially circular second flange 284) disposed on an end of the second cylindrical portion 282. In particular embodiments, a radius of the second flange 284 corresponds to the radius of the first flange 224. As shown in FIG. 10, the second flange 284 defines a second flange inner face 285 that is configured to engage, for example, an outer face of the shelf bracket 120 (e.g., when the shelf bracket 120 is coupled to the main bracket bar 111), a rear face of the main bracket bar 111, at least a portion of the lip 332, etc.).

As may be understood from FIG. 11, when assembling the main bracket bar/shelf bracket coupling mechanism 200, the first flanged component 220 may be coupled to the second flanged component 280 by inserting the second cylindrical portion 282 into the second flanged component receiving recess 226. In various embodiments, the second cylindrical portion 282 may be inserted into the second flanged component receiving recess 226 through the coupling mechanism cutout 300 and a hole defined in the shelf bracket 120. In various embodiments, the first flanged component 220 may then be at least temporarily coupled to the second flanged component 280 (e.g., using a suitable adhesive, welding, etc.). In other aspects, the second cylindrical portion 282 and second flanged component receiving recess 226 may be threaded such that the second flanged component 280 may be screwed into the first flanged component 220. In other aspects, the main bracket bar/shelf bracket coupling mechanism 200 may comprise any suitable number of components or pieces assembled in any suitable manner to result in the form of the main bracket bar/shelf bracket coupling mechanism 200 shown (e.g., or in a suitable alternative form to achieve the coupling function described herein).

As shown in FIG. 12, the resulting main bracket bar/shelf bracket coupling mechanism 200 is substantially spool-shaped (e.g., as in a sewing spool) and has a cylindrical inner portion with opposing end cap flanges. In various embodiments, these end cap flanges (and the inner portion) may have any suitable shape for coupling a main bracket bar 111 to a shelf bracket 120 via a suitable cutout in the shelf bracket 120 and the coupling mechanism cutout 300. In particular embodiments, the assembled main bracket bar/shelf bracket coupling mechanism 200 is substantially fixed (e.g., substantially permanently attached). This may occur, for example, during the assembly process such that each shelf bracket 120 is at least temporarily coupled (e.g., permanently coupled) to the main bracket bar 111 during shipping and sale. A purchaser/user may then unpack the bracket and shelf system for installation (discussed in more detail below).

Figure 13:
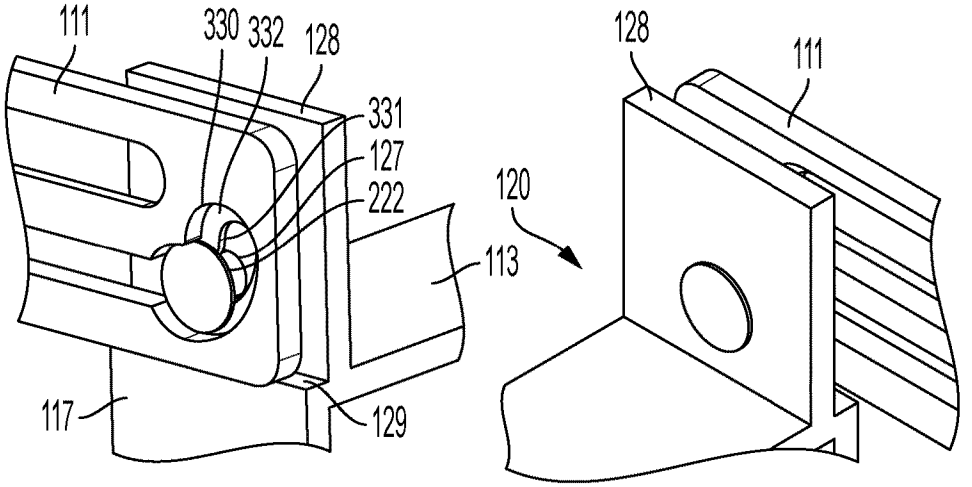
FIG. 13 is a front and rear detail view of a shelf bracket coupled to a main bracket bar according to various embodiments.

FIG. 13 is a front and rear detail view of a shelf bracket 120 coupled to a main bracket bar 111 according to various embodiments. As shown in this figure, when the main bracket bar 111 is coupled to the shelf bracket 120 using a main bracket bar/shelf bracket coupling mechanism 200 and an outer flange of the first cylindrical portion 222 (e.g., the first flange 224 or the second flange 284) is disposed within the routed cutout 330 (e.g., resting against the lip 332) the main bracket bar 111 is spaced apart from the main bracket bar coupling extension 128 of the shelf bracket 120 (e.g., by a distance that corresponds to a width of the main bracket bar support lip 129). The first cylindrical portion 222 is further disposed in the inner cutout 331 and has a diameter that substantially corresponds toa. diameter of the inner cutout 331 such that the first cylindrical portion 222 (e.g., and the shelf bracket 120) can slide along the inner cutout 331 (e.g., along the line 335 shown in FIG. 7 between the first point 333 and second point 334. In various embodiments, the length of the first cylindrical portion 222 enables the spacing apart of the main bracket bar 111 from the main bracket bar coupling extension 128. As may be understood from FIG. 13, the first cylindrical portion 222 is disposed in a coupling mechanism cutout 127 on the main bracket bar coupling extension 128, extending through the coupling mechanism cutout 127 such that the second outer flange of the main bracket bar/shelf bracket coupling mechanism 200 (e.g., the first flange 224 or the second flange 284) is disposed adjacent and engaging a front face of the main bracket bar coupling extension 128. In this way, the first flange 224 and second flange 284 cooperate to maintain the main bracket bar 111 adjacent the main bracket bar coupling extension 128, with room for the two components to space apart up to the depth of the routed cutout 330. As may be understood from FIG. 13, in this position, the shelf bracket 120 may rotate (e.g., about the main bracket bar/shelf bracket coupling mechanism 200/coupling mechanism cutout 127) as the wall support 117 has sufficient clearance to slide along the front face of the main bracket bar 111 until the shelf bracket 120 is in the folded position 150.

Figure 14:
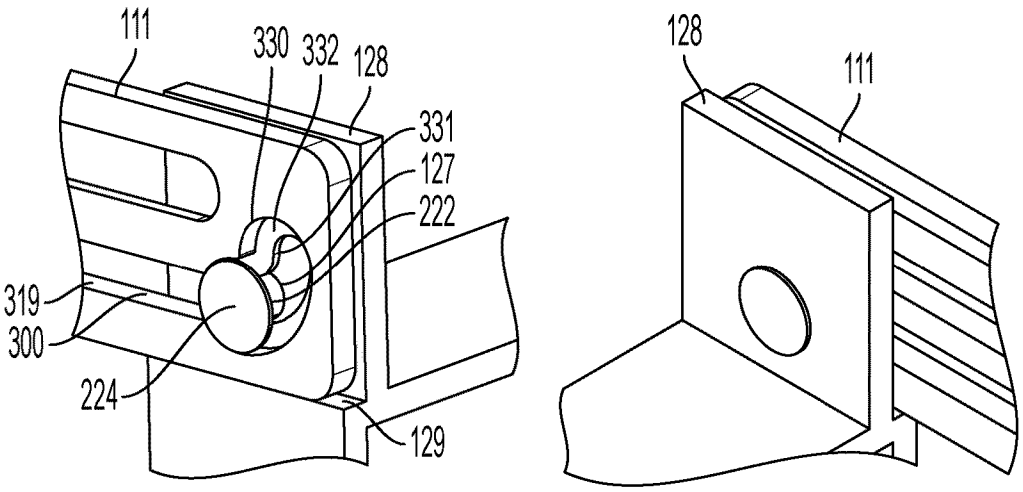
FIG. 14 is a front and rear detail view of a shelf bracket coupled to a main bracket bar according to various embodiments.

FIG. 14 is a front and rear detail view of a shelf bracket 120 coupled to a main bracket bar 111 according to a particular embodiment. As shown in this figure, the main bracket bar 111 has been pressed against the main bracket bar coupling extension 128 such that the main bracket bar 111 is in line with the main bracket bar support lip 129. As such, the first flange 224 is no longer disposed in the routed cutout 330 and is spaced apart from the lip 332 (e.g., because the second flange 284 is still pressed against the front face of the main bracket bar coupling extension 128). As may be understood from this figure, the first flange 224 is sufficiently clear of the main bracket bar 111 that the first cylindrical portion 222 is free to slide along the coupling mechanism cutout 300 via the elongated coupling mechanism support cutout 319. In this way, the shelf bracket 120 can slide laterally along the elongated coupling mechanism support cutout 319 such that the main bracket bar support lip 129 and the main bracket bar coupling extension 128 slide along a length of the main bracket bar 111.

Figure 15:
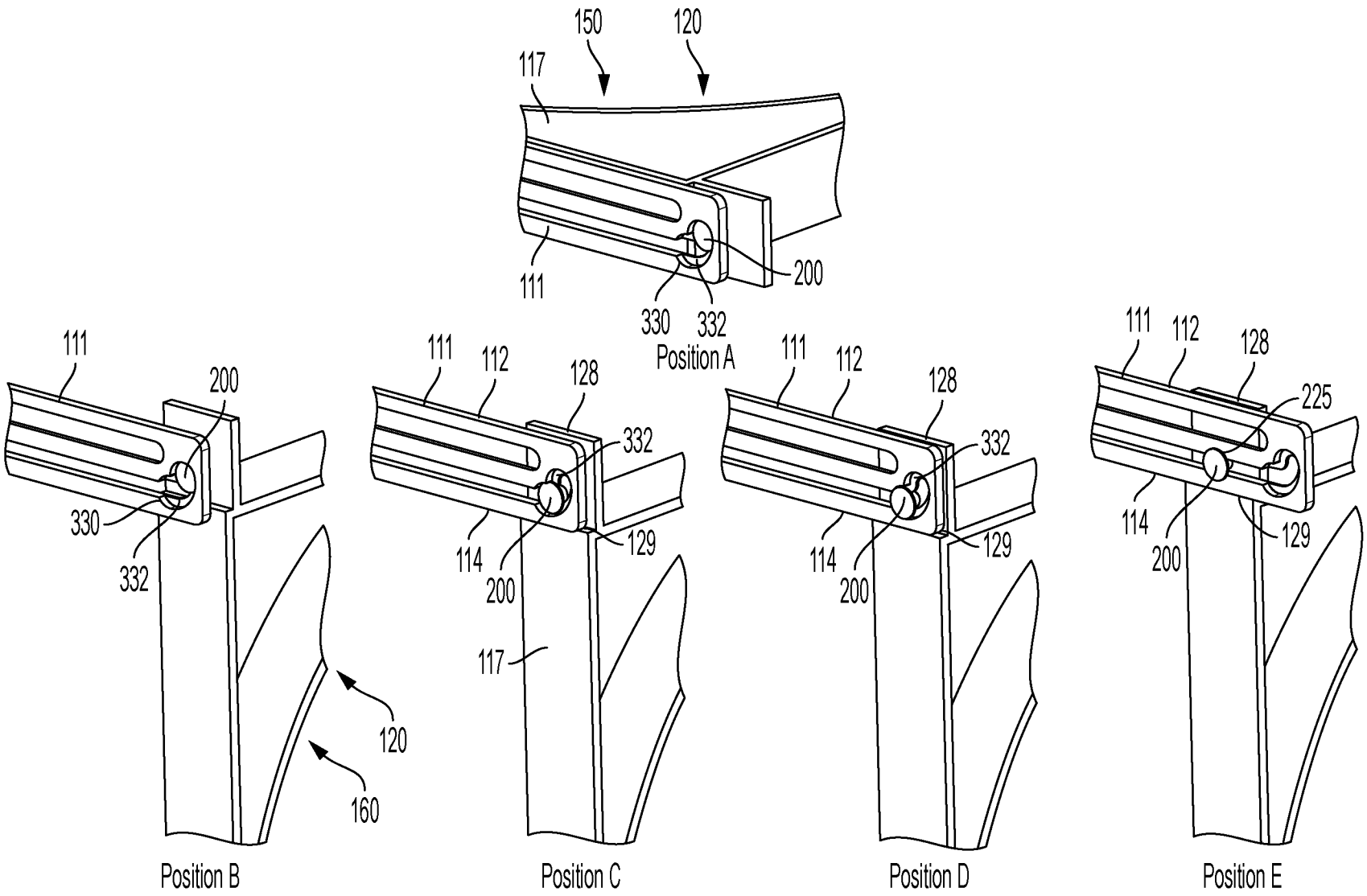
FIG. 15 depicts a shelf bracket coupled to a main bracket bar of the shelf and bracket system transitioning from a folded position to a support position.

FIG. 15 depicts a process for rotating the shelf bracket 120 relative to the main bracket bar 111 from the folded position 150 to the support position 160. As shown in this series of figures, in Position A, the main bracket bar 111 and the shelf bracket 120 are in the flat pack position (e.g., the shelf bracket 120 is in the folded position 150). In position A, the shelf bracket 120 is couples to the main bracket bar 111 using a main bracket bar/shelf bracket coupling mechanism 200 that is disposed in the routed cutout 330, with the main bracket bar/shelf bracket coupling mechanism 200 engaging the lip 332. The main bracket bar coupling extension 128 is spaced apart from the main bracket bar 111 by a distance that corresponds to the main bracket bar support lip 129. The main bracket bar/shelf bracket coupling mechanism 200 is centered about the second point 334 in the routed cutout 330. In Position B, the shelf bracket 120 has been rotated (e.g., about the main bracket bar/shelf bracket coupling mechanism 200) to the support position 160. The main bracket bar/shelf bracket coupling mechanism 200 is still resting against the lip 332 in the routed cutout 330 and the main bracket bar coupling extension 128 is still spaced apart from the main bracket bar 111 (e.g., about the distance of the width of the main bracket bar support lip 129). Continuing to Position C, the shelf bracket 120 (e.g., and the main bracket bar/shelf bracket coupling mechanism 200) are slid along the line 335 from the second point 334 to the first point 333 (e.g., such that the main bracket bar/shelf bracket coupling mechanism 200 (e.g., a center point of the main bracket bar/shelf bracket coupling mechanism 200) traverses the line 335 until the main bracket bar/shelf bracket coupling mechanism 200 is centered on the first point 333). As the main bracket bar/shelf bracket coupling mechanism 200 reaches the first point 333, the main bracket bar 111 clears the wall support 117 and slides along the main bracket bar support lip 129 until the main bracket bar top surface 112 is aligned with a top of the main bracket bar coupling extension 128 and the main bracket bar bottom surface 114 is aligned with the main bracket bar support lip 129. In position D, the main bracket bar 111 is pressed against the main bracket bar coupling extension 128 such that the main bracket bar bottom surface 114 slides against the main bracket bar support lip 129 (e.g., engages the main bracket bar support lip 129) and the front of the main bracket bar 111 engages the rear face of the main bracket bar coupling extension 128. In this position, the flange of the main bracket bar/shelf bracket coupling mechanism 200 is spaced apart from the lip 332, and clear of the rear face of the main bracket bar 111 such that the main bracket bar/shelf bracket coupling mechanism 200 (e.g., and the shelf bracket 120 to which it is coupled via the coupling mechanism cutout 127) can slide within the elongated coupling mechanism support cutout 319, with the flange of the main bracket bar/shelf bracket coupling mechanism 200 engaging the main bracket bar 111 adjacent the elongated coupling mechanism support cutout 319. In Position E, the main bracket bar/shelf bracket coupling mechanism 200 can then slide laterally within the elongated coupling mechanism support cutout 319. In various aspects, a length of the first cylindrical portion 222 and a thickness of the main bracket bar coupling extension 128 and main bracket bar 111 are coordinated such that the flanges of the main bracket bar/shelf bracket coupling mechanism 200 provide sufficient squeezing force between the main bracket bar coupling extension 128 and main bracket bar 111 (e.g., in position E or another desired position along the elongated coupling mechanism support cutout 319) such that the shelf bracket 120 is sufficiently laterally secure during installation, while providing enough give to enable straightforward force application to slide the shelf bracket 120 to the desired lateral position.

Figure 16:
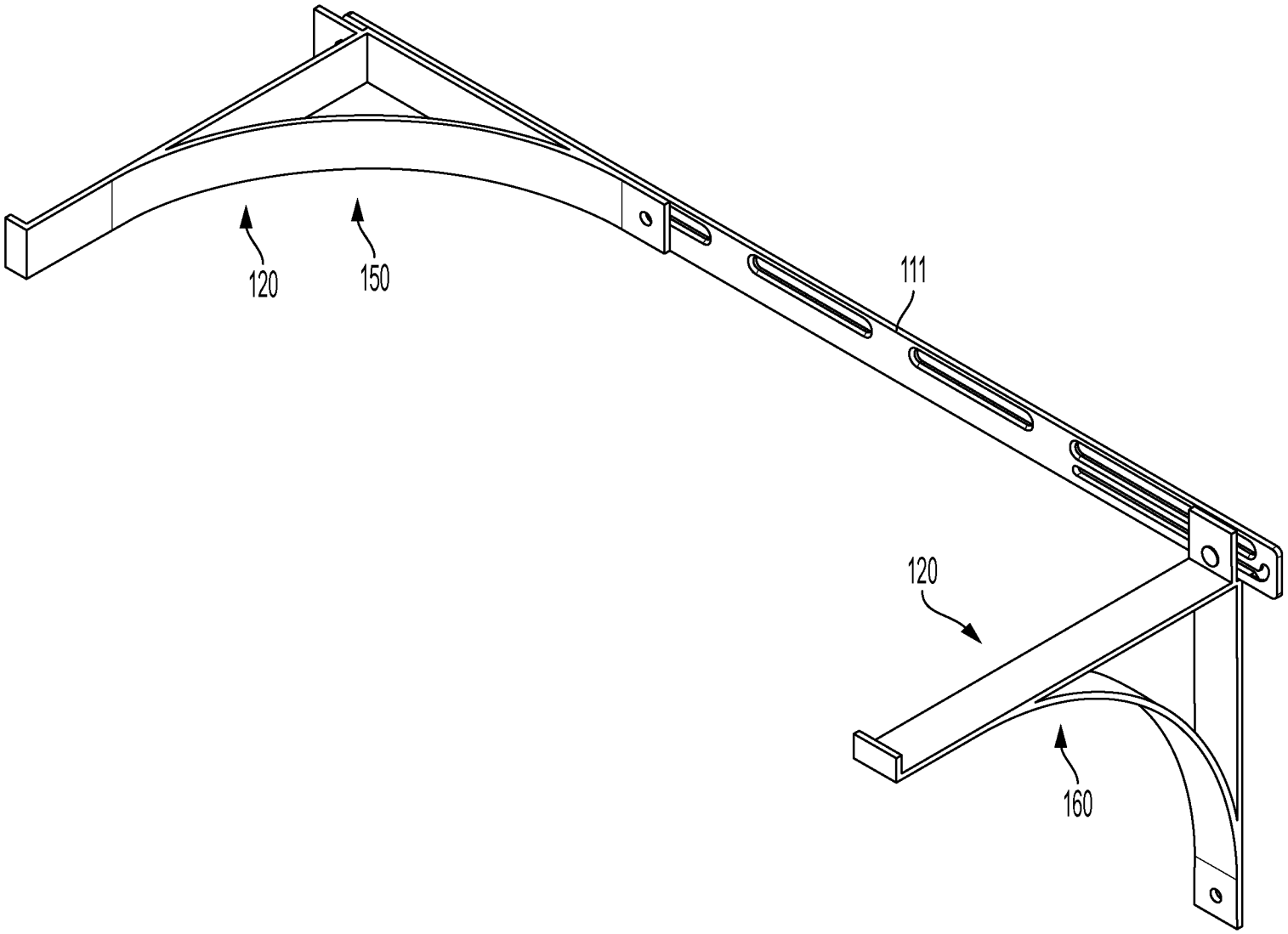
FIG. 16 depicts a front perspective view of a shelf and bracket system according to various embodiments of the present disclosure with a first shelf bracket in a support position and a second shelf bracket in a folded position.

FIG. 16 depicts a front perspective view of the main bracket bar 111 with a first shelf bracket 120 and a second shelf bracket 120 coupled to the main bracket bar 111. As shown in this Figure, the first shelf bracket 120 is in the folded position 150, while the second shelf bracket 120 is in the support position 160. As may be understood from this disclosure, this positioning represents a transition between a packed position and a mounting position.

Figure 17:
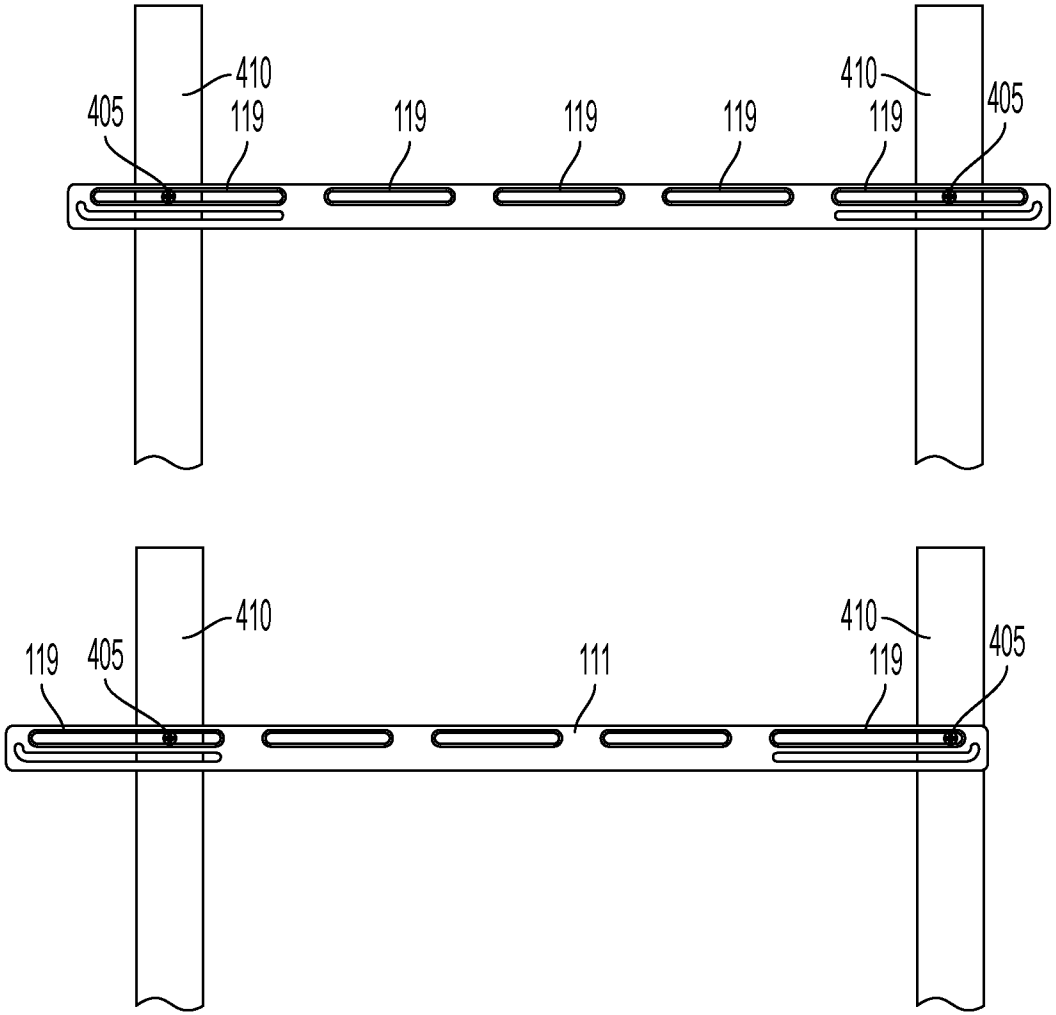
FIG. 17 is a front view of a main bracket bar of the shelf and bracket system mounted to a studded wall in various positions relative to the studs.
Figure 18:
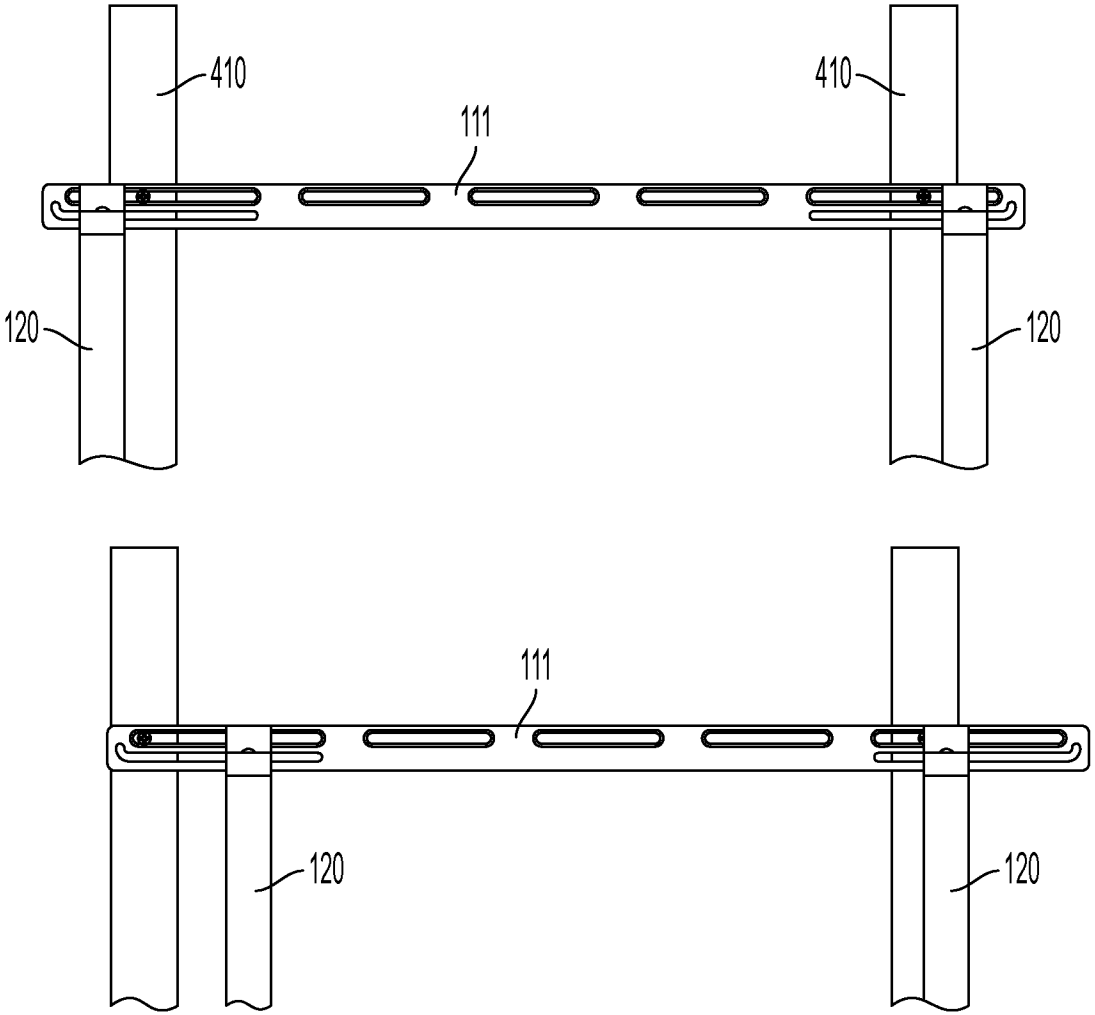
FIG. 18 is a front view of shelf brackets coupled to the main bracket bar shown in FIG. 17 according to various embodiments.
Figure 19:
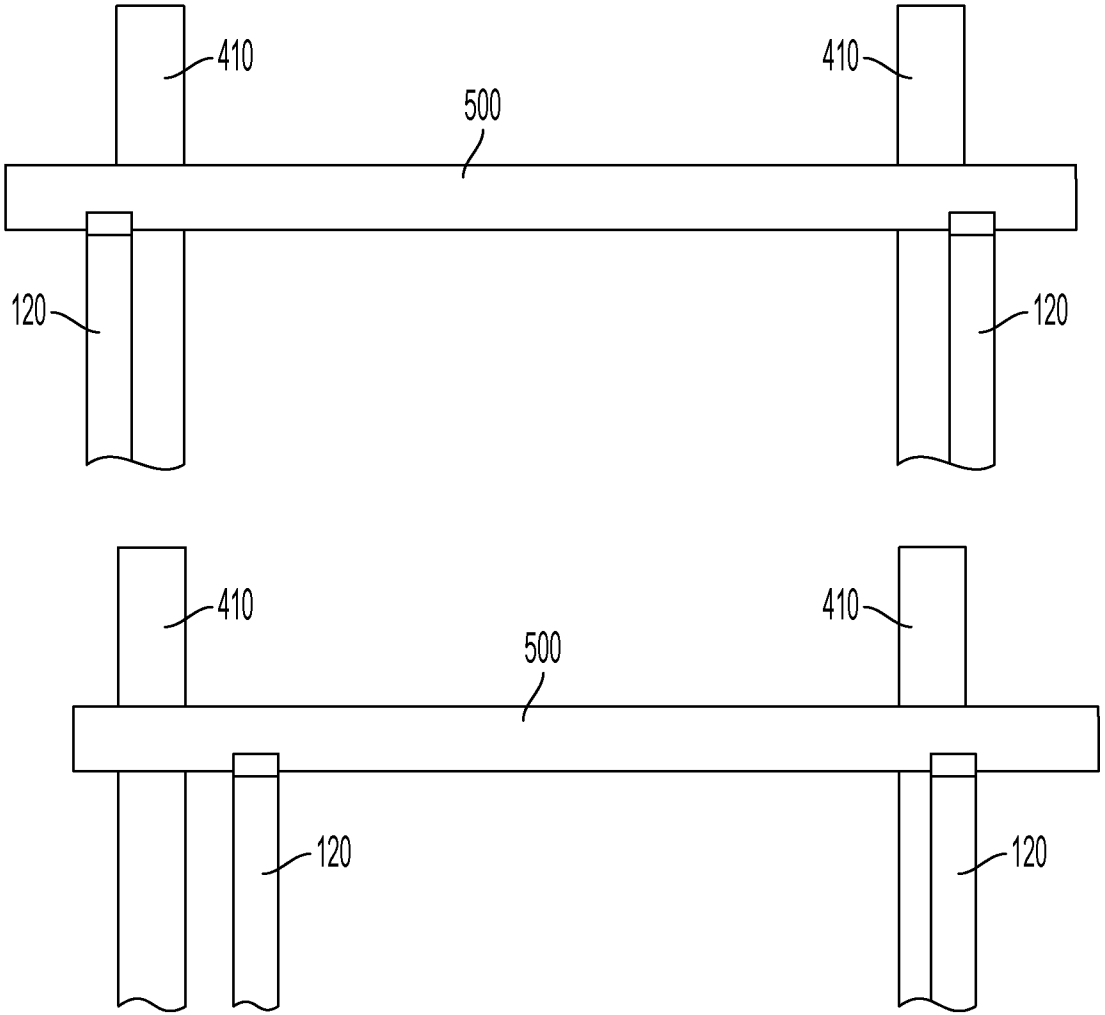
FIG. 19 is a front view of shelves coupled to the shelf brackets of FIG. 18 in various positions according to various embodiments.
Figure 20:
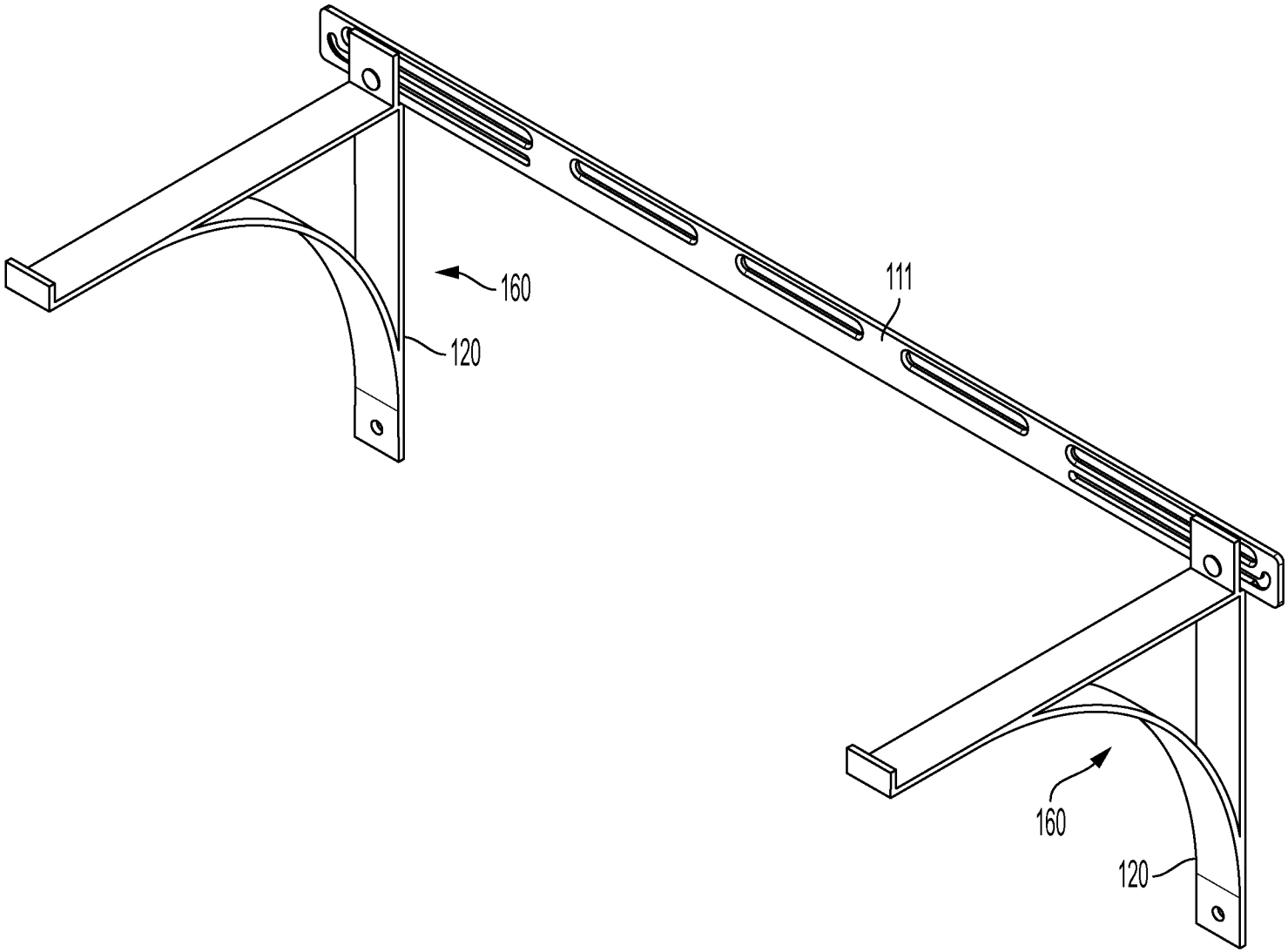
FIG. 20 depicts a front perspective view of a shelf and bracket system according to various embodiments of the present disclosure with a first shelf bracket in a support position and a second shelf bracket in a support position.
Figure 21:
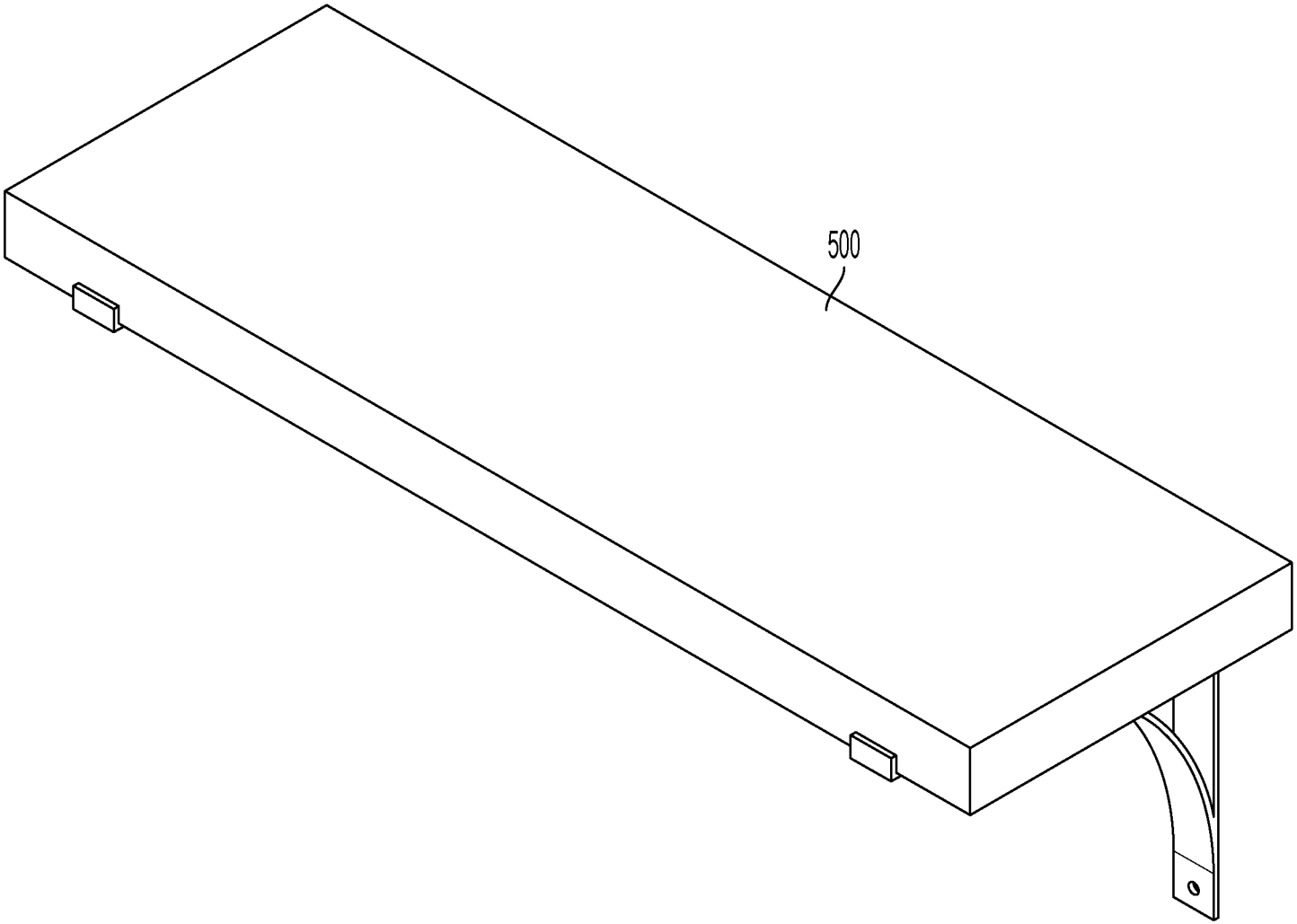
FIG. 21 depicts a shelf coupled to the shelf and bracket system of FIG. 20.

FIG. 17 is a front view of the main bracket bar 111 coupled to a first and second 410 (e.g., via a respective 405). As shown in this Figure, the main bracket bar 111 can be positioned with each 405 in any position along a length of a respective elongated mounting cutout 119. In this way, the main bracket bar 111 can be mounted (e.g., to a support surface) in any desired lateral position along a wall. Although this figure does not depict any shelf bracket 120, it should be understood that in application, each shelf bracket 120 will be at least temporarily (e.g., permanently) coupled to the shelf bracket 120 for straightforward packing and shipping as well as unfolding for installation. Each shelf bracket 120 is merely omitted to better illustrate how the main bracket bar 111 is mounted to each 410. In application, a user could simply slide each shelf bracket 120 to a suitable position such that neither shelf bracket 120 would interfere with mounting the main bracket bar 111 to each 410 at the desired position (e.g., using at least one 405). FIG. 18 shows a first shelf bracket 120 and a second shelf bracket 120 coupled to the main bracket bar 111. As may be understood from this figure, each shelf bracket 120 may be positioned in any lateral position within the elongated coupling mechanism support cutout 319 for mounting purposes. In this way, a final shelf placement may be selected, and each component may be positioned in any desired location for achieving the final shelf placement (e.g., as shown in FIG. 18 with the shelf 500 mounted on each shelf bracket 120). In various embodiments, each shelf bracket 120 may be slidably coupled to the main bracket bar, such that the respective main bracket bar/shelf bracket coupling mechanism 200 can slide within the elongated coupling mechanism support cutout 319 (e.g., even when the main bracket bar 111 is mounted to one or more studs 410 or other support surface. FIG. 19 shows a front view with a first and second shelf bracket supporting a shelf 500. In some embodiments, the system may further utilize one or more fasteners to maintain a lower portion of each shelf bracket 120 adjacent the support surface (e.g., such as screws through holes adjacent a lower portion of the shelf bracket 120 or in any other suitable location. FIG. 20 shows a perspective front view of the bracket and shelf system with a first and second shelf bracket 120 both in the support position 160. FIG. 21 shows the perspective view of the shelf 500 mounted on the bracket assembly 110.

In various embodiments, the shelf 500 can vary in size and shape. For example, the shelf 500 can be in the shape of a square, a rectangle, a circle, an oval, and/or the like. Accordingly, the bracket assembly 110 may comprise various number of shelf bracket 120 (e.g., support arms) as may be required to accommodate different sizes and/or shapes of the shelf 500. In addition, the bracket assembly 110 may comprise a plurality of shelf bracket 120 having varying lengths to accommodate different sizes and/or shapes of the shelf 500. Likewise, the main bracket bar 111 can vary in length to accommodate different sizes and/or shapes of the shelf 500. Furthermore, the interchangeability of each shelf bracket 120 can allow the support arms to be changed to accommodate different sizes and/or shapes of the shelf 500.

CONCLUSION

One of ordinary skill in the art will recognize that the described examples are not limited to any particular size. Further, one of ordinary skill in the art will recognize that the shelf 500 bracket assembly 110 (i.e., any components thereof) are not limited to any type of material. One of ordinary skilled in the art will recognize that a number of designs, types, and/or thicknesses of materials can be utilized when taking into consideration aesthetic, safety, and stability consideration. Similarly, a number of suitable fasteners and other coupling mechanisms may be employed for at least temporarily coupling and/or fastening one component to another (e.g., or one component to a support surface). A number of manufacturing techniques can be used in manufacturing the shelf and bracket system.

It will be appreciated by one of ordinary skilled in the art that changes can be made to the embodiments described herein without departing from the broad inventive concept thereof. It is understood, therefore, that the disclosure provided herein is not limited to the particular embodiments described, and is intended to cover modifications within the spirit and scope of the present disclosure. Several alternative embodiments and examples have been described and illustrated herein. One of ordinary skill in the art can appreciate the features of the individual embodiments, and the possible combinations and variations of the components. One of ordinary skill in the art can further appreciate that any of the embodiments could be provided in any combination with the other embodiments disclosed herein.

What is claimed is:

1. A shelf and bracket system comprising:
a shelf; and
a bracket assembly that comprises:
a main bracket bar,
a plurality of support arms,
first hardware for attaching each of the plurality of support arms to the main bracket bar,
second hardware for attaching the shelf to each of the plurality of support arms, and
third hardware for attaching the main bracket bar to a vertical support surface, wherein each support arm is disposed adjacent a respective end of the main bracket bar and the respective first hardware for the support arm is configured such that, when disengaged, the support arm is configured to rotate between a shelf support position and a folded storage position so that when each of the plurality of support arms are in the folded storage position, the bracket assembly is substantially flat, wherein the first hardware for the support arm is configured such that, when engaged, the support arm is coupled to the main bracket bar, and the first hardware is slidably disposed in an elongated coupling mechanism support cutout disposed laterally along a width of the main bracket bar.

2. The shelf and bracket system of claim 1, wherein each of the plurality of support arms is configured to direct at least a portion of a weight of the shelf into the vertical support surface when the plurality of support arms are in the shelf support position.

3. The shelf and bracket system of claim 1, wherein each of the plurality of support arms is configured to put weight onto the main bracket bar while minimizing shear force on the first hardware when the plurality of support arms are in the shelf support position.

4. The shelf and bracket system of claim 1, wherein the first hardware is substantially spool-shaped.

5. The shelf and bracket system of claim 1, wherein each of the plurality of support arms comprises a recess at the respective end of the support arm to maintain the support arm in a substantially perpendicular orientation relative to the main bracket bar when the first hardware is engaged with one or more outside surfaces of the main bracket bar to attach the support arm to the main bracket bar.

6. The shelf and bracket system of claim 1, wherein the support arm is configured to slide laterally along a length of the elongated coupling mechanism support cutout.

7. The shelf and bracket system of claim 1, wherein the main bracket bar defines a routed cutout disposed adjacent an outer end of the elongated coupling mechanism support cutout.

8. The shelf and bracket system of claim 7, wherein the first hardware is configured to disengage when the first hardware is disposed within the routed cutout such that the support arm can rotate with respect to the main bracket bar about the first hardware.

9. The shelf and bracket system of claim 8, wherein the routed cutout is defined by a curved line that extends between a first point adjacent an end of the elongated coupling mechanism support cutout and a second point that is centrally disposed between a main bracket bar top surface and a main bracket bar bottom surface.

10. The shelf and bracket system of claim 9, wherein the routed cutout defines a ledge configured to engage a flange of the first hardware when the first hardware is disposed in the routed cutout.

11. A shelf and bracket system comprising:
a shelf; and
a bracket assembly that comprises:
a main bracket bar,
a plurality of support arms, and
respective first hardware for attaching each of the plurality of support arms to the main bracket bar, wherein each support arm is disposed adjacent a respective end of the main bracket bar and the respective first hardware for the support arm is configured such that, when disengaged, the support arm is configured to rotate between a shelf support position and a folded storage position so that when each of the plurality of support arms are in the folded storage position, the bracket assembly is substantially flat, wherein the first hardware for the support arm is configured such that, when engaged, the support arm is coupled to the main bracket bar, and the first hardware is slidably disposed in an elongated coupling mechanism support cutout disposed laterally along a width of the main bracket bar.

12. The shelf and bracket system of claim 11, wherein each respective first hardware comprises a cylinder having a first flange disposed on a first end of the cylinder and a second flange disposed on a second end of the cylinder.

13. The shelf and bracket system of claim 12, wherein the first flange is configured to engage the main bracket bar and the second flange is configured to engage a particular support arm of the plurality of support arms to maintain the main bracket bar adjacent the particular support arm.

14. The shelf and bracket system of claim 11, wherein each of the plurality of support arms comprises a recess at the respective end of the support arm to maintain the support arm in a substantially perpendicular orientation relative to the main bracket bar when the respective first hardware is engaged with one or more outside surfaces of the main bracket bar to attach the support arm to the main bracket bar.

15. A shelf and bracket system comprising:

a shelf; and a bracket assembly that comprises:

a main bracket bar, a plurality of support arms, first hardware for attaching each of the plurality of support arms to the main bracket bar, second hardware for attaching the shelf to each of the plurality of support arms, and third hardware for attaching the main bracket bar to a vertical support surface, wherein each support arm is disposed adjacent a respective end of the main bracket bar and the respective first hardware for the support arm is configured such that, when disengaged, the support arm is configured to rotate between a shelf support position and a folded storage position so that when each of the plurality of support arms are in the folded storage position, the bracket assembly is substantially flat, wherein the main bracket bar comprises an elongated cutout for each of the plurality of support arms to allow for an adjustment of spacing between the plurality of support arms by sliding a respective support arm laterally closer or farther away from at least one other of the plurality of support arms.

16. The shelf and bracket system of claim 15, wherein each respective first hardware comprises a cylinder having a first flange disposed on a first end of the cylinder and a second flange disposed on a second end of the cylinder.

17. The shelf and bracket system of claim 16, wherein the first flange is configured to engage the main bracket bar and the second flange is configured to engage a particular support arm of the plurality of support arms to maintain the main bracket bar adjacent the particular support arm.

18. The shelf and bracket system of claim 16, wherein:

the first hardware comprises a first flanged component comprising the first flange and a second flanged component comprising the second flange; and the first flanged component is configured to selectively couple to and decouple from the second flanged component.

19. The shelf and bracket system of claim 15, wherein the main bracket bar defines a routed cutout disposed adjacent an outer end of the elongated cutout.

20. The shelf and bracket system of claim 19, wherein the first hardware is configured to disengage when the first hardware is disposed within the routed cutout such that the support arm can rotate with respect to the main bracket bar about the first hardware.

* * * * *